United States Patent [19]

Miller

[11] 4,186,890

[45] Feb. 5, 1980

[54] MECHANISM AND METHOD FOR TRANSFERRING YARN FROM A FULL PACKAGE TO AN EMPTY BOBBIN

[75] Inventor: Harry B. Miller, Charlotte, N.C.

[73] Assignee: Industrie-Werke Karlsruhe Augsburg Aktiengesellschaft, Fed. Rep. of Germany

[21] Appl. No.: 966,670

[22] Filed: Dec. 5, 1978

Related U.S. Application Data

[63] Continuation-in-part of Ser. No. 809,676, Jun. 24, 1977, abandoned.

[51] Int. Cl.[2] ..... B65H 54/06; B65H 67/04

[52] U.S. Cl. ..... 242/18 A; 242/18 PW; 242/19

[58] Field of Search ..... 242/18 A, 18 PW, 18 DD, 242/25 A, 19

[56] References Cited

U.S. PATENT DOCUMENTS

| | | | |
|---|---|---|---|
| 3,310,247 | 3/1967 | Emery | 242/18 A |
| 3,355,117 | 11/1967 | Gerhardt et al. | 242/18 A |
| 3,708,133 | 1/1973 | McErlane et al. | 242/18 A |
| 3,717,310 | 2/1973 | Ritter | 242/18 A |
| 3,856,222 | 12/1974 | Wust | 242/18 A |
| 3,876,161 | 4/1975 | Miller | 242/18 A |
| 3,913,852 | 10/1975 | Lenk et al. | 242/18 A |
| 4,033,519 | 7/1977 | Abe et al. | 242/18 A |
| 4,034,923 | 7/1977 | Miller | 242/18 A |

*Primary Examiner*—Stanley N. Gilreath
*Attorney, Agent, or Firm*—McGlew and Tuttle

[57] ABSTRACT

The winder includes pairs of rotatable chucks each supporting one or more bobbins. The two chucks of each pair include a top chuck and a bottom chuck operatively associated with a common drive roll, although the chucks may be driven otherwise. A traverse housing extends parallel to the chucks and has respective traverse guides for each bobbin. A yarn pickup or pusher is mounted on the housing for displacement longitudinally thereof by a cable cylinder. A respective yarn transfer device is associated with each chuck for swinging about the axis of the chuck between the retracted position and a yarn transfer position. Each device includes a bar or tube extending parallel to the associated chuck throughout substantially its entire length. While yarn packages are being wound at high speed on one chuck of each pair, the other chuck is in a retracted standby position. When the packages are nearly fully found, the standby chuck is brought up to speed, the yarn pusher disengages the yarns from the traverse guides and moves the yarns to the starting ends of bobbins on the standby chucks, and still rotating full packages are retracted from the drive roll. The transfer device of the standby chuck then swings its arm between the full packages and the drive roll to the transfer position to engage the yarns and move them to pick-up grooves at the starting points of the bobbins on the rotating standby chucks, where the yarns are caught by clamps or hooks, with the yarns then being severed. The yarn pusher then releases the yarns into the traverse guides, for winding on the standby chuck bobbins, the transfer device is retracted, and the full packages on the other chuck are removed and replaced by empty bobbins.

10 Claims, 10 Drawing Figures

MECHANISM AND METHOD FOR TRANSFERRING YARN FROM A FULL PACKAGE TO AN EMPTY BOBBIN

FIELD AND BACKGROUND OF THE INVENTION

This is a continuation-in-part of copending application Ser. No. 809,676 filed June 24, 1977, now abandoned.

Modern winders, for winding yarn into yarn packages on bobbins or tubes, generally include two or more rotatable chucks, each supporting one or more bobbons or tubes. While one chuck is being rotated for winding yarn into packages on bobbins or tubes mounted thereon, empty bobbins or tubes are placed on a second chuck then in a standby condition. When full packages have been wound on the first chuck, the latter is brought to a stop and the full packages are removed therefrom. It is then necessary for the winder operator or attendant to properly thread the yarn for winding on the bobbins or tubes on the second chuck.

The threading of the yarn is usually effected by feeding the end of the yarn into an aspirator or the like, and then using a "differ" to engage the yarn in transverse guides for proper winding in a criss-cross manner on the bobbins or tubes. Such rethreading or reguiding of the yarn, when full packages have been wound so that yarn can begin to be wound on empty bobbins or tubes, requires a considerable amount of time. More important, however, is the waste involved, particularly when yarns are being fed at very high speeds. Additionally, it is difficult, with known winders, to obtain accurately sized packages as well as uniform packages.

The changeover time required for switching yarn from a full package to an empty bobbin or tube is of particularly great importance with the heavy denier yarns now being used to an increasing extent. It is important that the changeover time be kept to a minimum, and the magnitude of the changeover time is in direct relation to the amount of yarn wasted during transfer from a full package to an empty bobbin or tube. The foregoing factors are becoming of increasing importance with the development of winders using pairs of top and bottom chucks on opposite sides of a traverse housing, with each chuck accommodating two or more tubes or bobbins. While such winders increase the efficiency of the yarn winding operation, the increase in efficiency is hampered by the time required to transfer from a full bobbin or package to an empty bobbin or tube. In some of the more modern winders, used with heavier denier yarn, the speed of yarn feed is so fast that it is necessary to make a transfer from a full package to an empty bobbin or tube substantially every ten minutes. This involves relatively high labor costs due to the number of personnel required.

Consequently, there is a need for a mechanism for automatically transferring yarn from a full package to an empty bobbin or tube, for winding on the latter, without manual assistaance, as, with such a mechanism, the operation would be much more accurate from the standpoint of package size and much more uniform, in addition to which the waste will be reduced to a minimum, but tolerable, amount.

SUMMARY OF THE INVENTION

This invention relates to yarn winders and, more particularly, to a novel and improved mechanism and method for automatically transferring yarn being wound at high speed into a yarn package, from the nearly full package to an empty bobbin or tube without reducing the yarn speed and with very little or no loss of yarn during the transfer.

In accordance with the invention, the yarn transfer mechanism is applicable to a yarn winder having pairs of chucks, with each pair including a top chuck and a bottom chuck, each adapted to have mounted thereon at least one bobbin or tube and preferably two or more bobbins or tubes. A traverse housing and cam extends parallel to the pairs of chucks, and includes the usual traverse guides, each respective to a bobbin or tube, for guiding the yarn for cross winding yarn packages on the tubes or bobbins. Each pair of chucks is operatively associated with a common drive roll which effects rotation of the bobbins or tubes, or of the yarn packages thereon, by direct engagement therewith, at uniform speeds. Only one chuck at a time is in operative association with the drive roll, and the other chuck is in retracted or standby relation to the drive roll. In the usual manner, the chucks are laterally displaceable toward and away from the drive roll, both when stationary and when rotating.

In addition, either each bobbin is provided with a peripheral groove adjacent the "starting" end thereof, as shown in copending U.S. application Ser. No. 690,967, filed May 28, 1976, or each chuck may be provided with a peripheral groove adjacent the "starting" end of each bobbin mounted thereon, and suitable yarn catching means, such as a hook, a clasp, or the like, may be associated with each groove in the chuck. These grooves serve to "catch" yarn drawn thereinto for wrapping of a few turns of yarn on the bobbin, starting from the "starting" end of the bobbin, to form a transfer tail for use, for example, with the transfer tails mechanism shown in U.S. application Ser. No. 690,967, after which the yarn is cross-wound by the associated traverse guides.

To transfer automatically the yarn being wound on a nearly full package to an empty bobbin, each chuck has operatively associated therewith a respective yarn transfer means which is rotatable about the axis of the associated chuck, and the traverse housing has mounted thereon yarn pickup means, operable by suitable mechanism, such as a cable cylinder, to disengage the yarn, then being wound on a nearly full package, from the associated traverse guides and then guide the yarn to a point adjacent the yarn catching means, such as a groove, associated with each bobbin. Each yarn transfer means includes a rod or bar, preferably cylindrical in cross-section, extending substantially the full length of the associated chuck, and revolvable about the axis of the associated chuck, each rod or bar having a slot therein substantially aligned with a yarn catching groove or the like of the associated chuck.

In the operation of the mechanism, and in accordance with the method of the invention, when the winding of a full package of yarn has been substantially completed, and upon signal, the yarn pickup is moved longitudinally of the traverse housing to catch the yarn or the yarns in the traverse guides and disengage the yarns from the traverse guides. The yarn pickup means then moves each of the disengaged yarns longitudinally of the chucks to a position where each disengaged yarn is substantially aligned with the yarn catching means of a chuck, such as a groove. At the same time, the chuck carrying the substantially fully wound package of yarn, is laterally displaced out of engagement with the associated drive roll to provide a substantial space between the yarn package and the drive roll. The yarn transfer means of the chuck on which the full package is being wound, is then rotated so that its notched arm engages the yarn or yarns caught by the yarn pickup, the yarn being engaged in the notches of the rod or bar. Upon further rotation of the yarn transfer means, the yarns engaged in the notches are brought into engagement with the yarn catching means or grooves associated with the empty bobbins on the other chuck, of the pair, which other chuck has been brought up to speed by engagement with the drive roll. The yarns are caught in the yarn catching means of the other chuck, or of the bobbins mounted thereon, and, due to the reversal of yarn direction, there is a tension developed which results in severing of the yarn, although a suitable yarn cutting means may be provided. With the yarn caught in the yarn catching means associated with the empty chuck, or the bobbins thereon, the transfer means is swing back to its retracted or inoperative position and the yarn is then wound on bobbins on the previously idle chucks. The chuck carrying the substantially full package of yarn continues to rotate for a while, due to its rotational inertia, and then is moved laterally into engagement with braking means which bring the chuck to a stop. The full yarn packages can then be removed and replaced by empty bobbins. The yarn being wound on the previously empty bobbins is again engaged in the yarn pickup which is moved longitudinally of the traverse housing to engage the yarn once again in the traverse guide for cross winding of the yarn.

While the two yarn transfer means associated with each pair of chucks, one associated with the upper chuck and the other associated with the lower chuck, are essentially similar in construction and operation, there is a slight difference therebetween. Thus, the yarn transfer means associated with the upper chuck need only be rotatable by a suitable means, such as a rotary actuator, to effect transfer of the yarn from a full package being wound on the upper chuck or top chuck to bobbins on the lower or bottom chuck. However, due to clearance problems, the transfer means operatively associated with the bottom chuck is not only rotatable, in the same manner as the transfer means operatively associated with the top chuck, but the notched rod or bar is also vertically displaceable, as by a pneumatic cylinder, from a retracted position, which it occupies when the yarn transfer means is in its retracted position, to an extended position to which the rod or bar is extended after the yarn transfer means is rotated to its "active" or "yarn transfer" position. Furthermore, in the case of the transfer of yarn from a full package being wound on the bottom chuck to empty bobbins being wound on the top chuck, the yarn pickup must perform a slightly greater longitudinal movement along the traverse housing in order to properly align the yarns, disengaged from the traverse guides, with the yarn catching grooves or the like of the top cylinder.

Although, as stated, the top and bottom chucks of each pair are rotated by engagement with the drive roll, or by engagement of packages thereon with the drive roll, the chucks may be independently rotated by suitable drive means whose speed is controlled in accordance with the size of the package being wound on bobbins thereon. Furthermore, each drive roll may be provided with an overdrive ring for providing even faster rotation for a chuck engaged therewith prior to engagement of the package being wound on bobbins on such chuck with the drive roll proper.

An object of the invention is to provide an improved apparatus for transferring yarn or the like, being wound at a high speed on a substantially full bobbin, to en empty bobbin rotated at a high speed.

Another object is to provide a method of transferring a yarn or the like, being wound at a high speed on a substantially full bobbin, to an empty bobbin rotated at a high speed on a winder without reducing yarn speed and with very low or no loss of yarn.

A further object of the invention is to provide such an apparatus and method in which the transfer from a full package to an empty bobbin is effected automatically.

For an understanding of the principles of the invention, reference is made to the following description of a typical embodiment thereof as illustrated in the accompanying drawings.

DESCRIPTION OF THE PREFERRED EMBODIMENT

Figure 1:
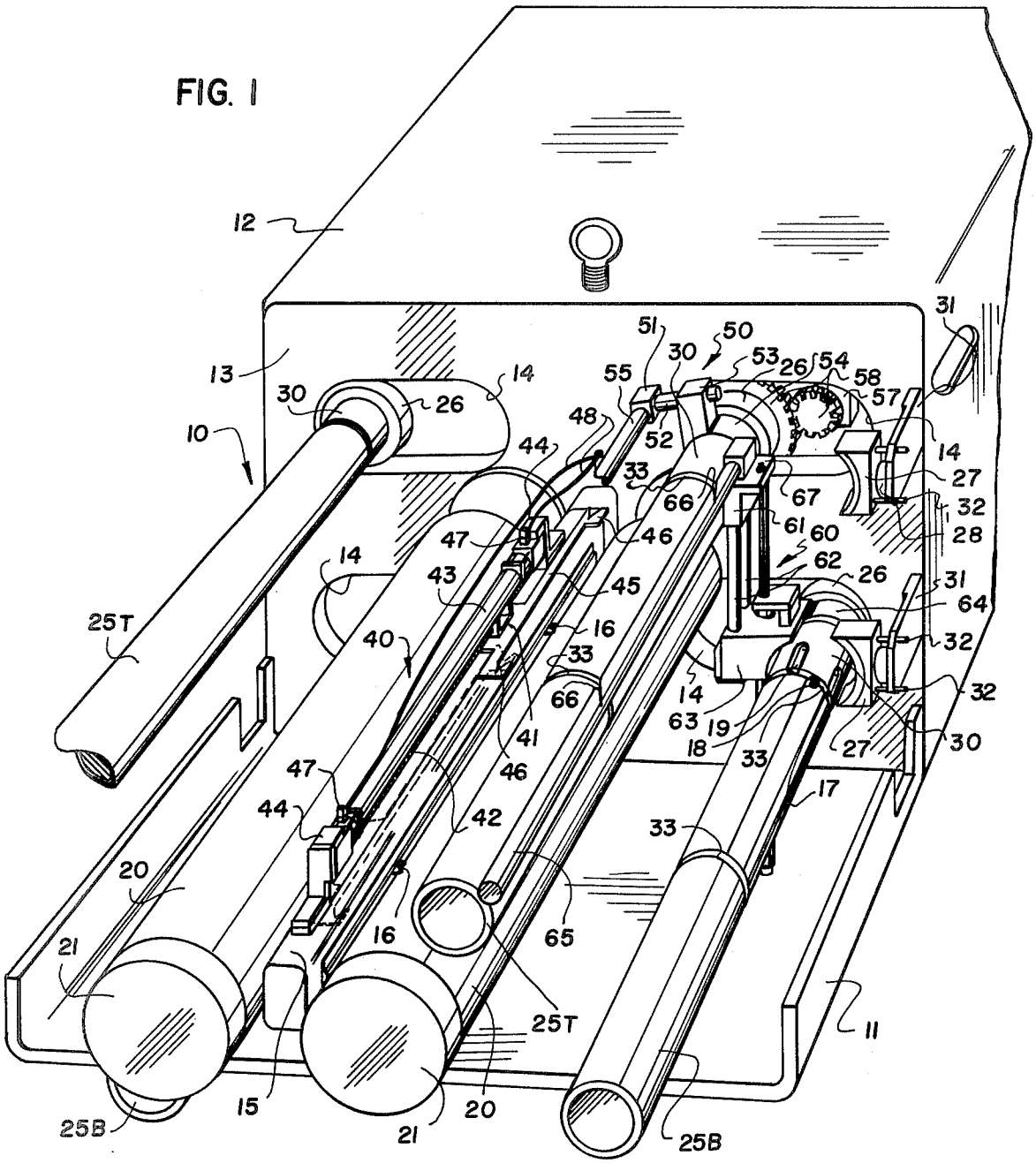
FIG. 1 is a partial perspective view of an automatic winder embodying the yarn transfer means of the present invention.
Figure 2:
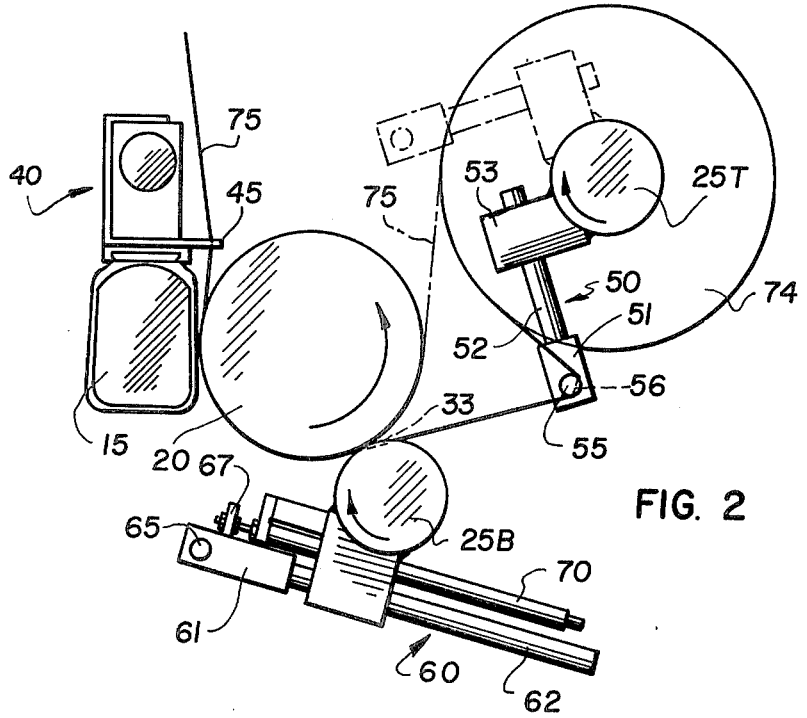
FIG. 2 is an end elevation view illustrating the operation of the yarn transfer means associated with a top chuck for transferring yarn, being wound in a substantially full package on the top chuck, to an empty bobbin mounted on a bobbin chuck.
Figure 3:
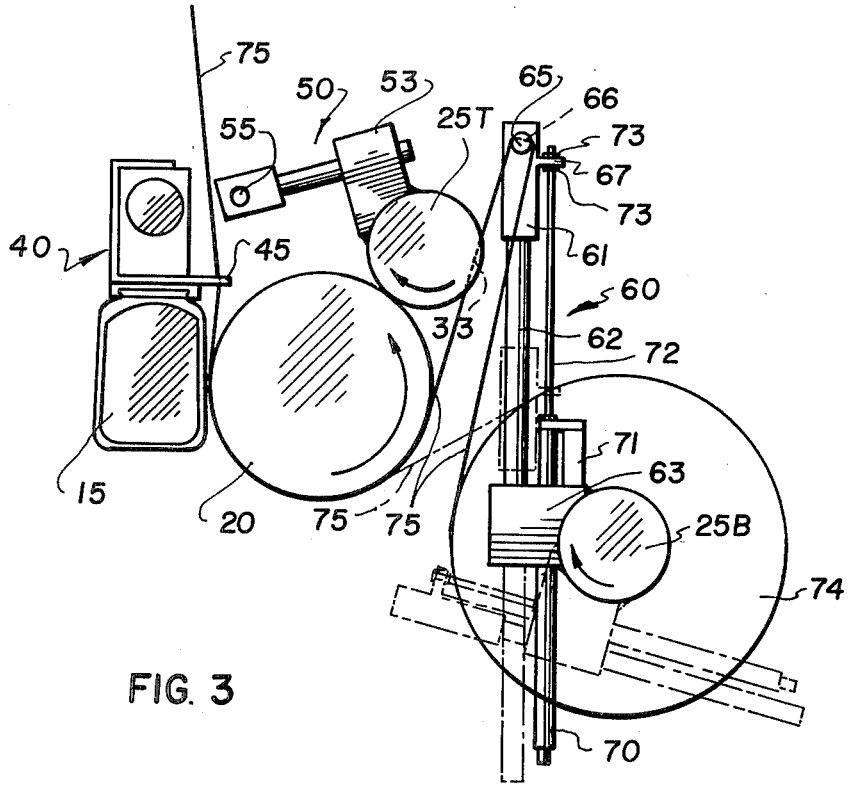
FIG. 3 is a view, similar to FIG. 2, illustrating the yarn transfer means associated with the bottom chuck and its operation in transferring a yarn, being wound in a substantially full package on the bottom chuck, to an empty bobbin on the top chuck.
Figure 5:
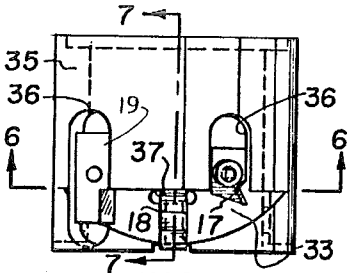
FIG. 5 is a side elevation view corresponding to FIG. 4.

Referring first to FIGS. 1, 2 and 3 of the drawings, a known four chuck yarn winder is generally indicated at 10 as including a base 11 and xover 12 for the winder mechanism. An upright front wall 13 extends upwardly from base 11 and closes the forward end of housing 12. For a purpose to be described, wall 13 is formed with four oval slots 14. A traverse housing and cam, generally indicated at 15, extends outwardly from wall 13 at substantially the center thereof and, in a known manner, is provided with traverse guides 16 which are reciprocated longitudinally of housing 15 for cross-winding yarn onto bobbins. Closely adjacent the opposite sides of traverse housing 15 there are two rotatable drive rolls 20, each mounted on wall 13, and driven in a manner described more fully hereinafter. The outer end of each drive roll is provided with an overdrive ring 21, such overdrive rings being known to those skilled in the art and being opersble to rotate a chuck, engaged therewith, at a higher speed than that at which the chuck would be rotated by a bobbin or package engaged with that part of the drive roll not provided with the overdrive ring 21.

In a known manner, winder 10 includes four rotatable chucks 25, arranged in pairs on opposite sides of traverse housing 15, with each pair including a top chuck indicated at 25T and a bottom chuck indicated at 25B. By means of respective roller bearings or the like indicated at 26, chucks 25 are displaceable laterally of slots 14 between an inactive retracted position and an active position. In the active position, each chuck is engageable with a drive roll 20, it being noted that each pair of chucks, 25T and 25B, is associated with a respective drive roll 20. As the arrangement to the left of traverse housing 15 is the mirror image of that to the right of the traverse housing, only the arrangement to the right thereof will be described in the following description, it being noted that traverse housing 15 includes traverse guides 16 on the left side thereof for cross-winding yarn on bobbins mounted on the chucks 25T and 25B to the left of the traverse housing. The roller bearings, generally designated at 26, are antifriction bearings of any suitable known type, and permit easy lateral displacement of the associated chucks 25. Additionally each chuck 25 is provided with one or more chuck pickup portions 30, described more fully hereinafter with reference to FIGS. 4 through 7, only one of these pickup portions 30 being shown in any detail in FIG. 1. The pickup portions 30 are located at the "starting" ends of bobbins mounted on each chuck 25. In addition, in its retracted position, each chuck is brought to a stop by a brake 27 operated by a fluid pressure actuator 28 mounted on a bracket 31 secured to wall 13 to project therefrom, the brakes 27 being guided by guide rods 32 engaged through apertures in brackets 31.

In accordance with the invention, to effect the transfer of the yarn between a nearly full package or packages being wound on a bobbin or bobbins on one chuck 25 of a pair to an empty bobbin or bobbins on the other chuck 25 of the pair, the transfer mechanism includes a yarn pickup, generally indicated at 40, mounted on traverse housing 15, a yarn transfer means, generally indicated at 50, operatively associated with the top chuck 25T, and a yarn transfer means, generally indicated at 60, operatively associated with the bottom chuck 25B. Yarn pickup 40 comprises a relatively elongated pusher or carrier 45 which has a substantially C-shape form with notched ends 46 with the notches both facing in the same direction. Pusher or carrier 45 is mounted on a bracket 41 to which are secured the opposite ends of a cable 42 extending through a cable cylinder 43 mounted in brackets 44 on traverse housing 15. Brackets 44 may also mount control switches 47, for controlling the limits of movement of pusher 45, and conductors 48 connect switches 47 to suitable mechanism (not shown) within winder cover 12. Yarn pickup 40 is effective, when operated by cable cylinder 43, to move from a retracted position, shown in broken lines, to the solid line position shown in FIG. 1. During such movement, notched ends 46 engage the yarns running through traverse guides 16 and disengage the yarns from these traverse guides. In into solid line position, yarn pickup 40 has moved the yarns into alignment with the yarn pickup means, or the grooves thereof, associated with the bottom cylinder 25B. After yarn transfer from a full package to an empty bobbin, cable cylinder 43 retracts yarn pickup 40, particularly the pusher or carrier 45 thereof, to the broken line position during which the yarns are again released into the traverse guide 16 for cross-winding of the yarn on the empty bobbin or bobbins. These movements are effected in conjunction with the movements of the yarn transfer means 50 and 60. The operating sequence and interrelation of the yarn pickup 40 and the yarn transfer means 50 and 60 will be described more fully hereinafter.

Referring more particularly to FIGS. 1 and 2, yarn transfer means 50, operatively associated with top chuck 25T, comprises an elongated rod or bar 55 extending substantially the full length of top chuck 25T, although illustrated broken away in FIG. 1. Bar 55 is formed with notches 56 extending at 45° to the longitudinal axis thereof and each substantially aligned with the groove of a respective pickup portion 30 of the two chucks 25T and 25B, and arranged to guide yarns, removed by pusher or carrier 45 from the traverse guides 16, into alignment with the grooves of the pickup portions 30 of bottom chuck 25B, and then to release the yarns for pusher or carrier 45 to reengage the yarn into the traverse guide 16.

For this purpose, rod 55 has its inner end secured in a block 51 secured, in turn, on an arm 52 adjustably mounted in a further block 53. In turn, block 53 is secured, as by welding or brazing, to a shaft 54 extending coaxially of to chuck 25T and rotatably through antifriction bearing 26. Shaft 54 is arranged to be angularly displaced by a rotary actuator 57 through the medium of meshing gears 58. Rotary actuator 57 is operable to swing arm 55 between the retracted position, shown in FIG. 1, and, in broken lines, in FIG. 2, and the operative position shown in solid lines in FIG. 2. Rotary actuator 57 may be a fluid pressure rotary actuator, an electrically operated rotary actuator, a stepping motor, or any equivalent rotary device. It should be noted that yarn transfer means 50, and particularly rod 55, performs only a rotary motion in moving between its operative and inoperative positions. The operation of yarn transfer means 50 in transferring yarn from a nearly full package or packages on top chuck 25T to an empty bobbin or bobbins on bottom chuck 25B will be described more fully hereinafter.

For reasons also described more fully hereinafter, bottom yarn transfer means differs somewhat from top transfer means 50. In the same manner as yarn transfer means 50, yarn transfer means 60 includes a yarn transfer rod or bar 65 extending substantially the full length of the top and bottom chucks 25T and 25B, respectively, and rod or bar 65 is formed with yarn engaging notches 66 extending at 45° to the longitudinal axis thereof. However, in the case of lower or bottom yarn transfer means 60, rod 65 is not only revolvable about the axis of bottom chuck 25B but also is linearly displaceable. Referring more particularly to FIGS. 1 and 3, the inner end of notched rod 65 is secured in a block 61 having a laterally projecting flange 67. Block 61 is secured on the upper end of two guide arms 62 which are slidably engaged through apertures or bores in a lower block 63. Block 63 is secured, as by brazing or welding, to a shaft 64 extending coaxially of lower chuck 25B and rotatable in the lower antifriction bearing 26. Shaft 64 is rotatable by a rotary actuator (not shown) which is identical in construction with the rotary actuator 57 and which drives or angularly displaces shaft 64 through the medium of gears corresponding to the gears 58. The rotary actuator connected to shaft 64 is operable to angularly displace yarn transfer means 60 between the operative position shown in solid lines in FIGS. 1 and 3 and the inoperative position shown in dotted lines in FIG. 3. In the operative position, rods 62 extend upwardly but at a slight angle to the vertical.

As previously mentioned, rod 65 is not only revolvable about the axis of lower chuck 25B, but also is linearly displacable. For this purpose, a relatively elongated air cylinder 70 is mounted through an aperture in block 63 and secured in position by being anchored to a bracket 71 secured to block 63. Air cylinder 70 has a piston connected to a piston rod 72 whose outer end is secured to the flange 67 of block 61 by nuts 73. During rotary motion of yarn transfer means 60, rod 65 is retracted, as illustrated in dotted lines in FIG. 3, until the guide rods 62 have assumed a substantially or near vertical position illustrated in solid lines in FIG. 3. Then air cylinder 70 is operated to extend its piston rod 72 to move block 61 and rod 65 linearly to the extended position. As mentioned, the reason for the combined rotary and linear movement of rod 65 will be explained more fully during the description of the operation of the yarn transfer mechanism and of the method of operation.

Figure 6:
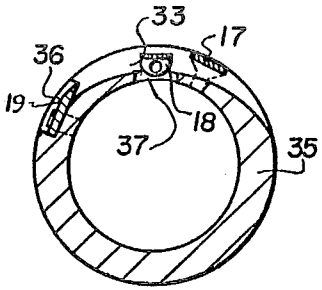
FIG. 6 is a sectional view taken on the line 6—6 of FIG. 5.
Figure 7:
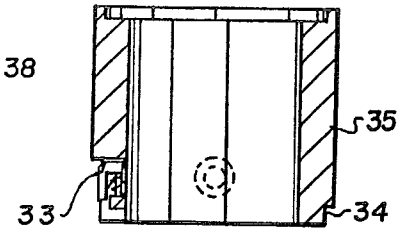
FIG. 7 is a sectional view taken on the line 7—7 of FIG. 5.
Figure 4:
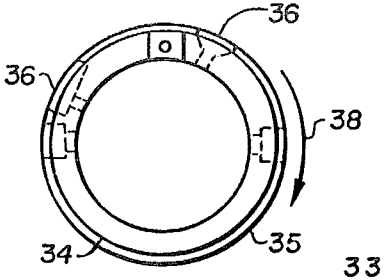
FIG. 4 is an end elevation view of the yarn pickup portion of a chuck.

The details of the chuck pickup portions are shown in FIGS. 4 through 7. Referring to these figures, each chuck pickup portion comprises a cylindrical sleeve 35 having a reduced diameter end, indicated at 34, for insertion into a chuck 25, and a recess in its opposite end for engaging another section of a chuck. Adjacent its end 34, sleeve 35 is formed with a V-shape arcuate groove 33 for engagement by a yarn. The outer periphery of sleeve 35 is formed with two elongated grooves or recesses 36 opening into groove 33. Between these grooves, sleeve 35 is formed with a slot 37 receiving a yarn clamp 18. Recesses 36 are angularly spaced from each other and, considered in the direction of rotation indicated by the arrow 38 of FIG. 4, the leading groove 36 receives a yarn catching hook 17 and the trailing groove 36 may receive a yarn cutter 19, if necessary, as shown in FIG. 1 and FIG. 6. Thus, yarn engaged into groove 33 is caught by the hook 17 and engages beneath and then becomes firmly held by the clamps 18. The yarn 75 so held then is severed, by being engaged through and severed by the cutter 19 as the yarn is guided relatively around the groove 33, from the yarn being wound on the full package, and is wound onto a package on the empty bobbin or bobbins on the associated chuck.

The method of the invention, in transferring yarn 75 from a nearly full package 74 to an empty bobbin or the like will now be described with particular reference to FIGS. 2 and 3. Initially, the operation of transferring yarn from a full package 74, being wound on a bobbin on upper chuck 25T by engagement of the full package with drive roll 20, to an empty bobbin on the lower chuck 25B will be described. Normally, the package being wound is in engagement with the drive roll 20 being rotated in the direction indicated by the arrow in FIG. 2. Each yarn 75 is "strung up" by initially being engaged in a respective traverse guide 16, and, from traverse guide 16, the yarn 75 is strung around and beneath the drive roll 20 and then up and over a bobbin on the upper chuck 25T, where the end of the yarn is engaged and clamped in a groove 33 in either the chuck or the bobbin. The bobbin is engaged with the roll 20 to be rotated at a very high speed to wind a yarn package 74 thereon, with the reciprocating traverse guide 16 cross winding the yarn on the package 74. The stringing of the yarn, both with respect to a package 74 on upper chuck 25T and with respect to a package 74 on lower chuck 25B is clearly indicated in FIGS. 2 and 3.

When the yarn package 74 being wound on a bobbin on upper chuck 25T is nearly completely wound, a yarn transfer initiating signal is given and, responsive to this signal, upper chuck 25T is displaced laterally along its associated slot 14 toward the associated brake 27 to leave a clearance between the package 74 and the drive roll 20. Meanwhile, yarn package 74 continues to rotate at a high speed due to the inertia of the parts. At the same time, a signal is given to yarn pickup 40 to activate cable cylinder 43 to displace pusher or carrier 45 from its broken line position to the solid line position illustrated in FIG. 1. During this movement, the notched ends 46 of carier or pusher 45 engage the yarn extending through traverse guides 16 and disengage the yarns from the traverse guides. At the end of the stroke, the yarns are aligned with respective grooves in the lower chuck 25B or in bobbins mounted thereon.

At this time, the signal is delived to the actuator 57 associated with the yarn transfer means 50, and the yarn transfer means is rotated through approximately 90° from the broken line position shown in FIG. 2 to the solid line position shown in FIG. 2. As a result of this rotation, the yarns are engaged in the notches 56 of the bar or rod 55 and the engaged yarns 75 are brought into the groove 33 of the lower chuck 25B or of bobbins mounted on the lower chuck, where the yarns are caught by hook 17 and clamped by clamp 18. The yarn is now still being wound on package 74, but it is not being cross-wound thereon. Due to the abrupt reversal of the yarn direction, the resulting tension causes the yarn 75 to be broken, or the yarn is cut by cutter 19, with the yarn end being clamped by clamp 18 associated with the lower chuck 25B. At this time, yarn transfer means 50 is immediately swung back to its inoperative position, with the yarn thus being released. The carrier or pusher 45 is then immediately retracted from its solid line position shown in FIG. 1, with the yarns being caught by the traverse guides 16 for cross-winding of a new yarn package on a bobbin on lower chuck 25B. The whole operation or transfer is performed in a very short time, having a duration of the order of milliseconds, so that the amount of waste yarn is very small, which is a very important consideration particularly in the winding of packages of heavy denier yarn. The upper chuck 25T carrying the full package 74 is then braked to a stop by operation of the associated brake 27, so that the full yarn package or packages can be removed from the upper chuck and replaced by empty bobbins.

In the succeeding yarn transfer operation, the yarn must be transferred from a full package being wound on a bobbin on lower chuck 25B to an empty bobbin on upper or top chuck 25T. In this case, there is a slight difference in geometry, as the bar 65 must travel a greater distance in moving the engaged yarn into engagement with a groove in the top chuck 25T or in a bobbin thereon than is necessary for the bar 55 in moving the engaged yarn into a groove in the lower chuck 25B or in an empty bobbin thereon. Consequently, the bar 65 would have to be at a substantially greater distance from the block 63 than the distance of the bar 55 from the block 53. However, the effective clearance between the full package 74 on lower chuck 25B and drive roll 20 is not sufficient to permit the bar 65 to be at a greater distance from the block 63 than the distance of the bar 55 from the block 53. It is for this reason that the bar 65 of the yarn transfer means 60 performs both a revolving movement about the axis of lower chuck 25B and a linear movement.

Figure 10:
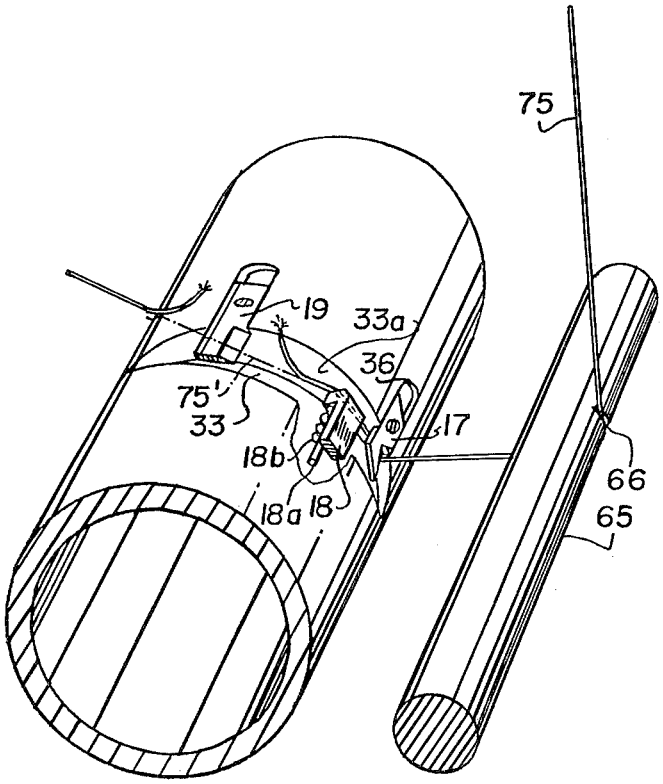
FIG. 10 is a perspective view of the yarn pickup portion of a chuck corresponding to FIG. 5 with portions cut away for clarity.

In transferring yarn from a nearly full package 74 on the lower chuck 25B to an empty bobbin on the upper chuck 25T, the yarn transfer initiating signal results in the bottom chuck 25B being moved outwardly in its associated slot 14 to disengage the substantially full package 74 thereon from the drive roll 20. At the same time, yarn packup 40 is activated so that cable cylinder 43 moves pusher or carrier 45 from its dotted line position to its solid line position to disengage the yarn from each of the traverse guides 16 and move the thus disengaged yarn into alignment with the grooves 33 in top chuck 25T or in empty bobbins mounted thereon. Immediately following this operation, the associated rotary actuator rotates shaft 64 to swing yarn transfer mechanism 60 from the broken line position shown in FIG. 3 to the solid line position shown therein with rod 65 remaining fully retracted as indicated in the broken line position. When yarn transfer means 60 has thus been angularly displaced to its solid line position, air cylinder 70 is actuated to move rod or bar 65 upwardly, and the yarn, already engaged in the notches 66 of bar 65, is moved upwardly so that it is brought into engagement with the groove or grooves in top chuck 25T or in the empty bobbins mounted thereon, whereupon the yarn is caught by hook 17 and clamped by a spring-biased clamp 18 to effect a reversal of the yarn movement resulting in severing of the yarn or, if necessary, the yarn may be cut by cutter 19. As shown in FIG. 10, clamp 18 is slidably mounted on a pin **18*a* and biased toward a flat face 33*a* of the slot 33 by spring 18B. Bar 65 with notch 66 guides yarn 75 into the vicinity of the chuck 35 whereafter the yarn 75 is caught by hook 17. Hook 17 draws the yarn 75 between clamp 18 and face 33*a*. The continued rotation of chuck 35 draws yarn 75 across cutter 19 causing the yarn to be severed. An instant before this cutting, yarn 75 is shown in dot dash line at 75'. The yarn then begins to be wound on the bobbins mounted on top chuck 25T, and bar 65 is first linearly retracted from its solid line position to a dotted line position shown in FIG. 3, and then shaft 64 is rotated by the rotary actuator to swing the entire yarn transfer mechanism 60 to the solid line position shown in FIG. 2. Cable cylinder 43 is activated to move yarn pusher or carrier 45 back toward its dotted line position so that the yarns are again engaged in the traverse guides 16 for cross-winding of the yarn on bobbins on top chuck 25T. The full package 74 on bottom chuck 25B continues to rotate until bottom chuck 25B is engaged by its associated brake 77** and brought to a stop, after which the full package or packages thereon may be removed and replaced by empty bobbins.

Due to the slight difference in geometry of the two yarn transfer means, the pusher or carrier 45, during transfer of yarn from the bottom chuck to the top chuck must be advanced slightly further than is necessary in transferring yarn from the top chuck to the bottom chuck, this distance being of the order of three eights to one half an inch. This is easily effected by the use of respective limit switches for the two different transfer operations, these limit switches controlling the extent to which the pusher or carrier 45 is advanced by the cable cylinder 43.

Normally, the inactive chuck 25T or 25B is in a retracted position near the right hand end of its associated slot 14. When the time comes to transfer the yarn from a full package to an empty bobbin, the inactive chuck, with the empty bobbins thereon, is moved to the left end of its associated slot 14 so that the chuck or the bobbins engage the overdrive ring 21 on the drive roll 20 and are brought up to a speed somewhat higher than the speed of rotation of the full package. The empty bobbins are rotated at this speed until sufficient yarn has been wound thereon so that the yarn package itself engages the drive roll 20 and thus the bobbin or chuck is disengaged from the overdrive ring 21. Furthermore, during the actual yarn transferring operation, the yarn is no longer being cross-wound on the full package but is "running" linearly, and this in turn contributes to the small amount of waste yarn. As stated, the entire transfer operation is effected very rapidly to the extent that it requires only milliseconds, and yarn saving is effected by the fact that the yarn continues to wind on the full package until it is cut by catching of the yarn in the groove of the empty bobbin or the groove of the associated chuck. Furthermore, this prevents slack in the yarn. While the bars or rods 55 and 65 have been shown as being formed with yarn engaging notches 56 or 66, respectively, it is also feasible to replace these notches with apertures and to apply a suction to the interior of these rods or bars, which would then have to be tubular, so that the yarn is held in proper position, in alignment with the grooves associated with the empty chuck, solely by the suction in the tubular rods or arms.

The time for initiating a transfer operation can be determined in various ways. Thus, a transfer operation could be started by a timer or it could be started by a mechanism measuring the diameter of a full package being wound. Also, it could be effected by a properly located switch which would be actuated responsive to movement of the active chuck away from the drive roll due to the increasing diameter of the package being wound.

Figure 8:
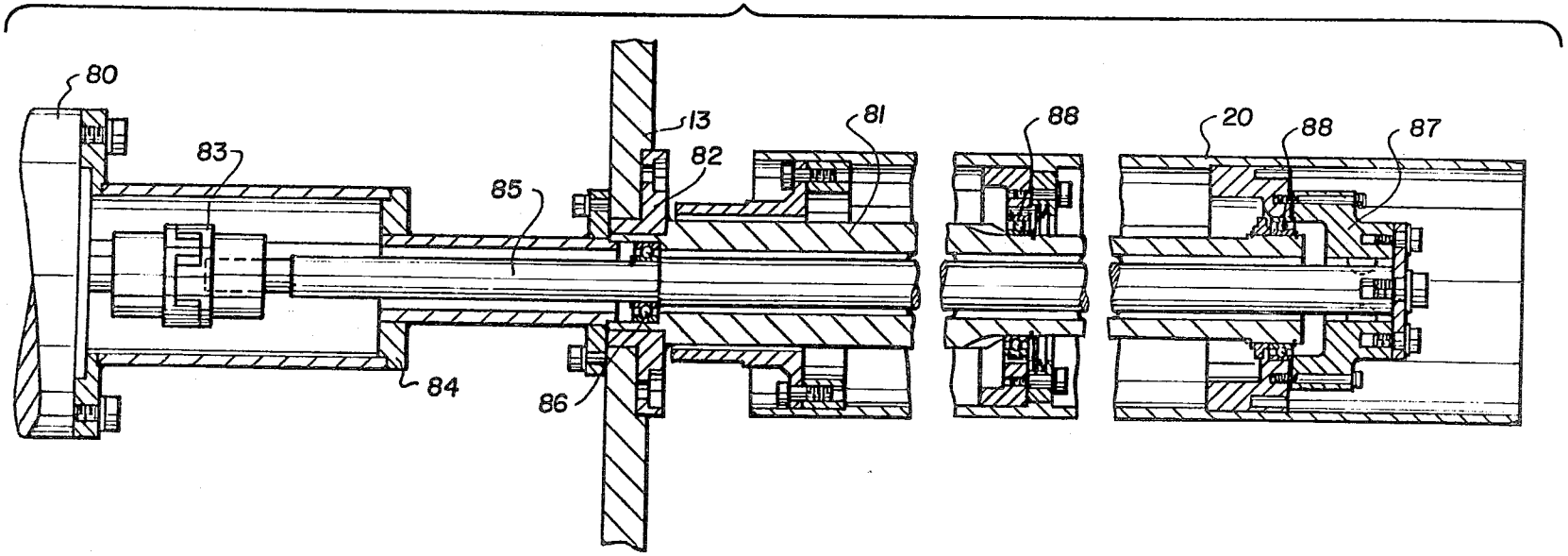
FIG. 8 is an axial sectional view illustrating the construction, mounting and drive of a drive roll.

As mentioned previously, the drive rolls 20 are mounted to extend forwardly from the front wall 13, and it is necessary that these drive rolls are very stable and do not wobble or have any play. An arrangement for assuring this is shown in FIG. 8. The actual drive roll 20 is relatively thin wall cylindrical shell which, of itself, would be subject to some deflection and whiplash if it were simply mounted rotatably on end wall 13 and driven, without any other support, by a suitable motor, such as the motor 80. In order to prevent such deflection and whiplash, a relatively massive tubular shaft 81 is mounted in wall 13 to extend therefrom by means of a flange 82 firmly connected with heavy tubular shaft 81. The motor 80 is supported within the winder cover 12, and has an output shaft coupled, by a coupling 83, to a drive shaft 85, the coupling 83 and the inner portion of the drive shaft 85 being enclosed within a tubular housing generally indicated at 84. Drive shaft 85 is rotatably engaged in massive shaft 81 through the medium of an antifriction bearing 86, which may be a ball bearing or a roller bearing. A coupling 87 connects the outer end of drive shaft 85 to drive roller 20 which is rotatably supported, by further antifriction ball or roller bearings 88, on the relatively massive shaft 81. Thereby relatively light drive roller 20 is rotatably supported on the relatively massive stationary shaft 81 and driven by the drive shaft 85 extending through the massive tubular shaft 81.

Figure 9:
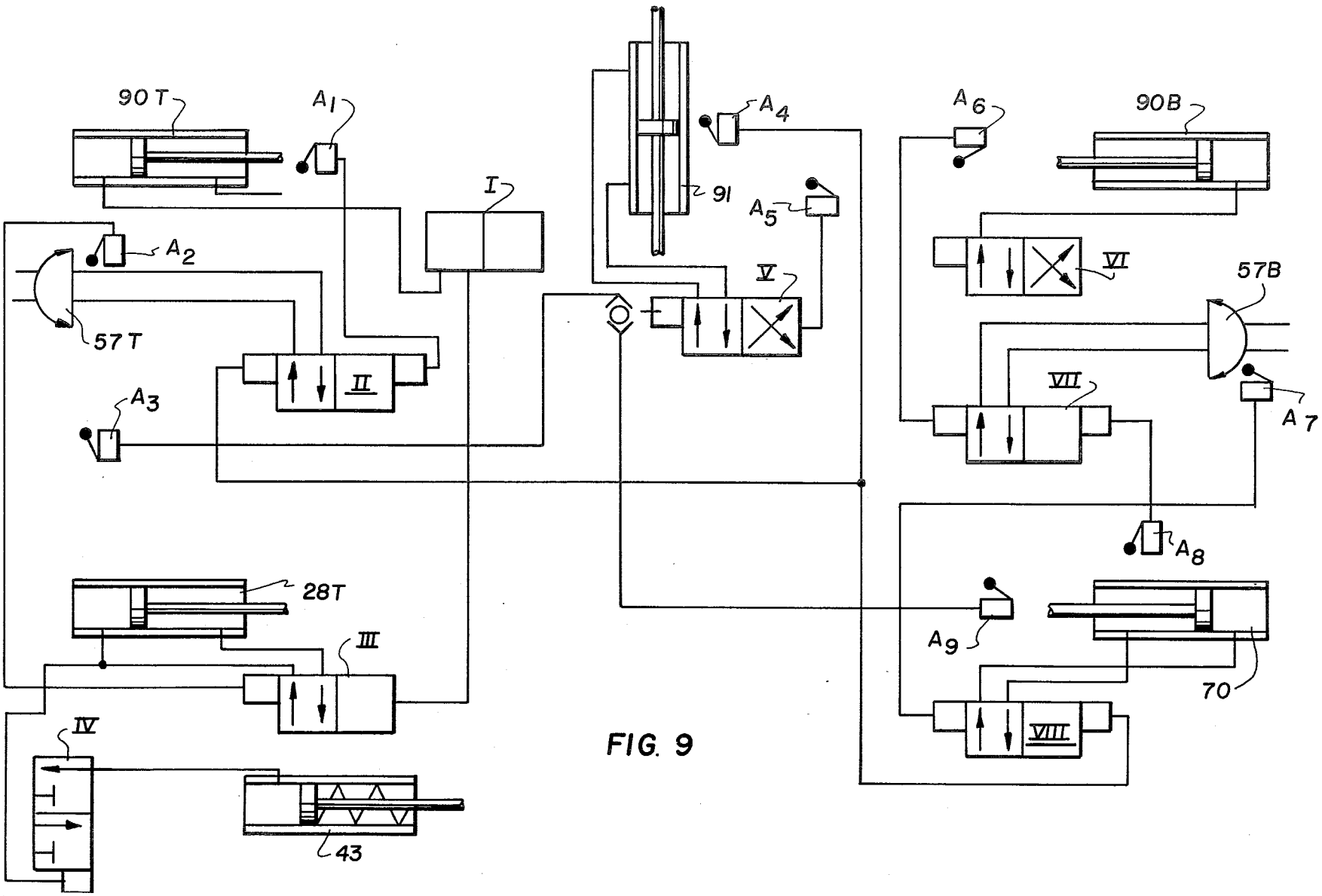
FIG. 9 is a schematic illustration of a pneumatic control system for the apparatus.

FIG. 9 schematically illustrates a pneumatic control system for the yarn transfer mechanism. In this figure, electromagnetically operated fluid pressure flow control valves, for the several linear and rotary actuators of the apparatus, are indicated by roman numerals, and these valves are controlled by respective switches A each designated with an appropriate suffix. The top and bottom chucks 25T and 25B, respectively, are displaced laterally in their respective slots 14 by respective linear fluid pressure actuators 90T and 90B engaged with the supports for the chuck. FIG. 9 also shows a further fluid pressure linear actuator 91 for operating the transfer tail mechanism such as shown in the mentioned copending U.S. application Ser. No. 690,967. The rotary actuators for the top yarn transfer means 50 and the bottom yarn transfer means 60 are indicated, in FIG. 9, at 57T and 57B, respectively. FIG. 9 further illustrates the air cylinder or fluid pressure linear actuator 70 for advancing and retracting the bottom yarn transfer means after it has been rotated into position by the associated rotary actuator 57B.

Referring more particularly to FIG. 9, the valve I controls actuation of linear actuator 90T which moves the support for the top chuck along the associated slot 14. When the top chuck 25T has been thus retracted to disengage the yarn package 74 from the drive roll 20, valve II activates the rotary actuator 57 to swing the top yarn transfer means 50 about the axis of chuck 25T to transfer yarn to the lower chuck 25B. Subsequently, brake cylinder 28T is activated under the control of valve III to brake the top chuck 25T to a stop. A time delay valve IV is then effective to activate the cylinder 43 of the yarn pickup 40 so that the yarn pickup releases the yarns or yarns into the traverse guides 16.

The valve V controls the linear actuator for the transfer tails mechanism, which has not been shown in the drawings but is clearly shown and described in copending U.S. application Ser. No. 690,967.

Switch $A_1$ is operated, in the "back position" of the upper chuck, by the linear actuator 90T to switch the valve II to appropriately activate the rotary actuator 57T for the top yarn transfer means 50. In its "normal" position, the rotary actuator 57T operates the switch $A_2$ to switch the valve III. The switch $A_3$ is operated by the rotary actuator when the upper yarn transfer means is in the yarn transfer position, shown in solid lines in FIG. 2, to switch the valve V.

Switch $A_4$ provides a signal, when the transfer tails mechanism is in its normal position, to set the valve II or the valve VIII back. When the transfer tails mechanism is in the yarn transfer position, the switch $A_5$ is activated to set the valve V back to its initial state.

With respect to the bottom chuck 25B, the valve VI controls the linear actuator 90B for moving the support of the lower chuck 25B along its associated slot 14. Valve VII controls the rotary actuator **57*b* for the bottom yarn transfer means 60 to turn the bottom yarn transfer means 60 into the solid line position shown in FIG. 3. Valve VII controls the vertical cylinder 70 to lift the lower yarn transfer means or "doffer" 60 to effect transfer of the yarn to the upper chuck 25T. The brake cylinder for the lower chuck and the time delay for the yarn pickup, associated with the lower chuck are not shown in FIG. 9**.

When the cylinder 90B has retracted the lower chuck 25B to disengage the yarn package 74 from the drive roll 20, switch A6 is operated to switch valve VII. This activates actuator 57B to move the lower "doffer" through the solid line position shown in FIG. 3, preliminary to extending the lower "doffer" upwardly. When the lower rotary actuator 57B has thus been rotated, switch $A_7$ is operated to switch the valve VIII controlling the vertical cylinder 70 of the lower yarn transfer means or "doffer" 60. The cylinder 70 is thus operated to extend the lower yarn transfer means 60 upwardly, as shown in FIG. 3. in the full solid line position of the block 61. Switch $A_8$ is operated by the linear actuator 70 to set the valve VII back to its original position, and switch $A_9$ is operated by the linear actuator 70 to switch the valve V to its normal position.

While an electro-pneumatic control has been indicated in FIG. 9, it should be understood that a fully pneumatic control or a fully electrical control, including the necessary actuators, could be provided for the mechanisms.

By reference to FIGS. 2 and 3, it will be noted that there is an abrupt reversal of the direction of yarn travel when the yarn is caught by hook 17 and clamped by clamp 18, in groove 33 of either a chuck or bobbin. This abrupt reversal of the yarn travel generally acts to sever the yarn with one severed end remaining gripped by clamp 18 and thus held in groove 33, and the other severed end travelling around the full package 74.

With further reference to FIGS. 2 and 3, it will be noted that some "slack" in the yarn is necessary for the transfer mechanisms 50 and 60 to operate. This slack is provided, in the first instance, due to the fact that the yarn, when engaged in the transfer means 50 or 60, is no longer being cross-wound on the full package 74, but is being fed linearly toward the package. Additional slack is provided by the slight deceleration of the package 74 when disengaged from a drive roll 20. Thus, sufficient slack is provided for the high speed transfer operation.

While a specific embodiment of the invention has been shown and described in detail to illustrate the application of the principles of the invention, it should be understood that the invention may be embodied otherwise without departing from these principles.

What is claimed is:

1. A method of transferring a yarn or the like, being cross-wound by traverse means into a yarn package, on a substantially full bobbin mounted on a first chuck, and rotated at a high speed by a drive roller, to an empty bobbin having a starting end, mounted on a second chuck arranged in spaced relation to the first chuck, and initially disengaged from the drive roll, without loss of yarn speed and with little or no waste of yarn, said method comprising the steps of moving the substantially completed yarn package, still rotating at a high speed, out of engagement with the drive roll to leave a space between the yarn package and the drive roll; engaging the empty bobbin with the drive roll for high speed rotation by the drive roll; disengaging the yarn from the traverse means to interrupt such cross-winding for linear feeding of the yarn across such space to the yarn package still rotating at high speed; guiding the disengaged yarn into alignment with the starting end of the empty bobbin; providing an elongated element extending, substantially parallel to the chucks, throughout substantially the full length of the chucks; swinging such elongated element about the axis of the first chuck to engage the yarn traversing said space and move the yarn into engagement with the starting end of the empty bobbin, now rotated at a high speed by the drive roll, for catching and severing of the yarn being fed to the completed yarn package and winding of the yarn on the empty bobbin; and re-engaging the yarn in the traverse means for cross-winding a new yarn package on the previously empty bobbin.

2. A method, as claimed in claim 1, including the step of providing a second elongated element swingable about the axis of said second chuck for transfer of yarn, being wound on a bobbin on said second chuck, to an empty bobbin on the first chuck.

3. Apparatus for transferring for transferring a yarn or the like, being cross-wound at a high speed onto a yarn package on a substantially full bobbin, to an empty bobbin having a starting end and rotated at a high speed without loss of yarn speed and with little or no loss of yarn, said apparatus comprising, in combination, means rotatably mounting said bobbins in spaced parallel relation to each other; a drive roll operable to rotate said bobbins when engaged therewith or with a yarn package being wound thereon; said empty bobbin initially being disengaged from said drive roll while said yarn package is engaged by said drive roll for rotation of said yarn package at such high speed; traverse means cross-winding the yarn fed to said substantially full bobbin to form the yarn package thereon; yarn gripping means adjacent the starting end of each bobbin; respective yarn transfer means operatively associated with each bobbin mounting means and each including an elongated yarn-engaging element extending parallel to substantially the full length of the associated bobbin; each yarn engaging element having yarn guide means aligned with the starting end of an empty bobbin; means operable, responsive to the yarn package on said full bobbin attaining a predetermined size, to engage said empty bobbin with said drive roll for rotation thereof at at least said high speed; means operable, responsive to said empty bobbin attaining at least such said high speed, to displace said substantially full bobbin, while rotating at a high speed, laterally away from said drive roll to provide a space between the yarn package on said substantially full bobbin and said drive roll; pickup means movable, from an inactive position, in a direction parallel to said bobbin to disengage the yarn from said traverse means, to interrupt such cross-winding for linear feeding of the yarn across such space to the yarn package still rotating at a high speed; operating means operable to displace said pickup means; means operable, responsive to displacement of the yarn package out of engagement with said drive roll, to move the associated yarn transfer means from a retracted position to move its yarn-engaging element between said substantially full bobbin and said drive roll and toward said empty bobbin to engage the yarn being fed across such space and move the yarn into engagement with said yarn gripping means associated with said empty bobbin, for severing of the yarn for winding at high speed on said empty bobbin, and then to return the yarn transfer means to its retracted position; said operating means thereupon displacing said pickup means to its inactive position to release the yarn into said traverse means for cross-winding a new yarn package on said empty bobbin.

4. Apparatus for transferring yarn or the like, as claimed in claim 3, in which each yarn transfer means includes means mounting its associated elongated yarn engaging element for rotation about the axis of the associated bobbin between an inactive position of its associated yarn-engaging element and an active position of its associated yarn-engaging element in which the latter engages the yarn traversing such space to move the yarn into engagment with said yarn gripping means associated with said empty bobbin.

5. Apparatus for transferring yarn or the like, as claimed in claim 4, in which said means rotatably mounting said bobbins in spaced parallel relation to each other comprises pairs of rotatable chucks, with each pair including a top chuck and a bottom chuck; the yarn transfer means operatively associated with each bottom chuck including a linear actuator operable, after its associated yarn-engaging element is engaged with the yarn traversing such space, to move the associated yarn-engaging element linearly upwardly toward the top chuck to engage the yarn, being fed across such space, with said gripping means associated with an empty bottom on the associated top chuck.

6. Apparatus for transferring a yarn or the like, as claimed in claim 3, including braking means engageable with the mounting means for said substantially full bobbin to brake the yarn package thereon to a stop for removal of said substantially full bobbin from its associated mounting means and engagement of new empty bobbin on its associated mounting means.

7. Apparatus for transferring the yarn or the like, as claimed in claim 3, including a traverse housing extending parallel to the mounting means for said bobbin and having said traverse means extending therefrom; said pickup means being mounted on said traverse housing for displacement longitudinally thereof to engage yarn engaged in the traverse means and disengage the yarn from said traverse means.

8. Apparatus for transferring yarn or the like, as claimed in claim 7, in which said operating means for displacing said pickup means comprises a cable cylinder mounted on said traverse housing and including a cable having its opposite ends connected to said pickup means.

9. Apparatus for transferring yarn or the like, as claimed in claim 3, in which said means operable to move said yarn transfer means from a retracted position and to return said yarn transfer means to be retracted position comprises respective rotary actuators effective to angularly displace the associated yarn transfer means about the axis of the means rotatably mounting the associated bobbin.

10. Apparatus for transferring a yarn or the like, as claimed in claim 3, in which said yarn gripping means comprises a respective groove in each chuck adjacent the starting end of each bobbin; and a respective spring-biased clamp extending into each groove to grip yarn engaged in the groove.

* * * * *